US010766072B2

(12) United States Patent
Ohara et al.

(10) Patent No.: US 10,766,072 B2
(45) Date of Patent: Sep. 8, 2020

(54) METHOD FOR PRODUCING HIGH DENSITY NICKEL POWDER

(71) Applicant: SUMITOMO METAL MINING CO., LTD., Tokyo (JP)

(72) Inventors: Hideki Ohara, Niihama (JP); Yoshitomo Ozaki, Niihama (JP); Shin-ichi Heguri, Niihama (JP); Kazuyuki Takaishi, Niihama (JP); Osamu Ikeda, Niihama (JP); Tomoaki Yoneyama, Niihama (JP); Yohei Kudo, Niihama (JP)

(73) Assignee: SUMITOMO METAL MINING CO., LTD. (JP)

( * ) Notice: Subject to any disclaimer, the term of this patent is extended or adjusted under 35 U.S.C. 154(b) by 153 days.

(21) Appl. No.: 15/770,523

(22) PCT Filed: Oct. 25, 2016

(86) PCT No.: PCT/JP2016/081632
§ 371 (c)(1),
(2) Date: Apr. 24, 2018

(87) PCT Pub. No.: WO2017/073578
PCT Pub. Date: May 4, 2017

(65) Prior Publication Data

US 2019/0054541 A1 Feb. 21, 2019

(30) Foreign Application Priority Data

Oct. 26, 2015 (JP) ..... 2015-210245

(51) Int. Cl.
*B22F 9/26* (2006.01)
*B22F 9/22* (2006.01)
(Continued)

(52) U.S. Cl.
CPC ..... *B22F 9/26* (2013.01); *B22F 9/22* (2013.01); *B22F 1/0011* (2013.01); *B22F 9/24* (2013.01);
(Continued)

(58) Field of Classification Search
None
See application file for complete search history.

(56) References Cited

U.S. PATENT DOCUMENTS 2,734,281 A * 2/1956 Kaufman, II ..... D06F 58/28 34/87
3,816,098 A * 6/1974 Mackiw ..... C22B 23/0446 75/370
(Continued)

FOREIGN PATENT DOCUMENTS

CA 2938194 A1 * 8/2015
JP 5796696 B1 8/2015
(Continued)

OTHER PUBLICATIONS

"The Manufacturing and Properties of Metal Powders Produced by the Gaseous Reduction of Aqueous Solutions" Written by Research and Development Division of Sherritt Gordon Mines, Ltd., Powder Metallurgy, vol. 1, pp. 40-52, 1958.

*Primary Examiner* — George Wyszomierski
(74) *Attorney, Agent, or Firm* — Gerald E. Hespos; Michael J. Porco; Matthew T. Hespos

(57) ABSTRACT

Provided is a method for producing high density nickel powder particularly having a median diameter of 100 to 160 μm by controlling a particle size of nickel powder. The method includes: performing an initial operation by charging a pressure vessel equipped with a stirrer with a nickel ammine complex solution containing nickel in the concentration of 5 to 75 g/L together with seed crystals in the amount of 5 to 200 g per liter of the solution, increasing the
(Continued)

temperature of the solution, and performing a reduction reaction with hydrogen by blowing hydrogen gas into the pressure vessel, thereby obtaining the nickel contained in the nickel ammine complex solution as nickel powder; and thereafter, performing a specified operation A repeatedly at least once to obtain the nickel powder having the median diameter of 100 to 160 μm and a bulk density of 1 to 4.5 g/cm$^3$.

2 Claims, 5 Drawing Sheets

(51) Int. Cl.

| | |
|---|---|
| *H01B 5/00* | (2006.01) |
| *B22F 1/00* | (2006.01) |
| *B22F 9/24* | (2006.01) |
| *C22C 1/04* | (2006.01) |

(52) U.S. Cl.
CPC ..... *B22F 2301/15* (2013.01); *C22C 1/0433* (2013.01); *H01B 5/00* (2013.01)

(56) References Cited

U.S. PATENT DOCUMENTS

| | | | | |
|---|---|---|---|---|
| 10,449,607 | B2 * | 10/2019 | Qin | B22F 9/26 |
| 2017/0008083 | A1 | 1/2017 | Yanagisawa et al. | |
| 2018/0009037 | A1 | 1/2018 | Heguri et al. | |

FOREIGN PATENT DOCUMENTS

| | | | |
|---|---|---|---|
| JP | 2015140480 | A | 8/2015 |
| WO | 2015115427 | A1 | 8/2015 |
| WO | 2015146989 | A1 | 10/2015 |

* cited by examiner

AFTER PERFORMING HYDROGEN REDUCTION REACTION ONCE

AFTER PERFORMING HYDROGEN REDUCTION REACTION THREE TIMES

AFTER PERFORMING HYDROGEN REDUCTION REACTION FIVE TIMES

AFTER PERFORMING HYDROGEN REDUCTION REACTION SEVEN TIMES

METHOD FOR PRODUCING HIGH DENSITY NICKEL POWDER

BACKGROUND

Field of the Invention

The present invention relates to a method for producing high purity and high density nickel powder by hydrogen reduction.

Description of the Related Art

As a method for industrially producing nickel powder expected to be used as a conductive paste material or a positive electrode active material for a nickel metal hydride battery or the like, there is a method employing a wet process. There are various methods for industrially producing nickel powder by the wet process, and one of the methods is a method for producing nickel powder by adding a reducing agent to a solution containing nickel for reducing a nickel ion contained in the solution. In particular, a reducing method by blowing hydrogen gas into an acidic solution containing nickel as a complex can be industrially inexpensively carried out, and hence is widely employed.

In this method, as described in Japanese Patent Laid-Open No. 2015-140480, a pressure vessel is charged with an ammine complex solution containing nickel, the vessel is sealed and heated, and hydrogen gas is blown thereinto, and thus nickel powder is obtained by reduction with hydrogen.

Nickel powder having a diameter of several tens μm or less has problems that dust is generated in drying the powder, and that a used filter is clogged in filtration of the powder. Differently from a case where a fine size of several tens μm or less is directly necessary as in an electronic material, in a case where the obtained nickel powder is dissolved in an acid again to be used as a material for obtaining a salt of a nickel compound or the like, a powder having a particle size of about 100 to 160 μm and a bulk density of about 1 to 4.5 g/cm$^3$ is suitable and desired from the viewpoints of both processability and handleability.

The nickel powder produced by the above-described method has, however, a problem that the powder has a large particle size but a low bulk density, namely, a density of the powder is liable to be low.

Such low density nickel powder requires time and effort for bulk handling, and in addition, has a problem that an impurity contained in the solution before the reduction is easily precipitated.

Therefore, nickel powder having a particle size of about 100 to 160 μm and simultaneously having a higher bulk density, namely, high density nickel powder, has been required.

Japanese Patent Laid-Open No. 2015-140480, however, merely describes a method of adding an organic additive as a method for controlling a particle size, but it is difficult to obtain high density nickel powder by this method alone, and it has been regarded as a significant problem to find another method.

Besides, although POWDER METALLURGY, 1958, No. 1/2, pp. 40-52 describes a method for industrially producing nickel powder, also this literature merely describes, as a method for controlling a particle size, that a particle size is increased by increasing an amount of nickel to be reduced, and thus, a method for obtaining high density nickel powder has not been found yet.

The present invention provides a method for producing high density nickel powder particularly having a median diameter of 100 to 160 μm by controlling a particle size of nickel powder.

SUMMARY

The first aspect of the present invention for solving the above-described problem is a method for producing nickel powder, including: performing an initial operation by charging a pressure vessel equipped with a stirrer with a nickel ammine complex solution containing nickel in the concentration of 5 g/L or more and 75 g/L or less together with seed crystals in the amount of 5 g or more and 200 g or less per liter of the complex solution, increasing the temperature of the solution, and blowing hydrogen gas into the pressure vessel for performing a reduction reaction with hydrogen, thereby obtaining the nickel contained in the nickel ammine complex solution as nickel powder; and performing, after the initial operation, operation A described below repeatedly at least once to obtain nickel powder having a median diameter of 100 μm or more and 160 μm or less and having a bulk density of 1 to 4.5 g/cm$^3$.

[Operation A] This is performed by: separating the obtained nickel powder according to a density for recovering nickel powder having a small density; and weighing the recovered nickel powder having a small density in the amount of 5 g or more and 200 g or less per liter of the nickel ammine complex solution containing nickel in the concentration of 5 g/L or more and 75 g/L or less, charging the pressure vessel equipped with the stirrer with the weighed nickel powder used as seed crystals together with the nickel ammine complex solution, increasing the temperature of the solution, and performing the reduction reaction with hydrogen by blowing hydrogen gas into the pressure vessel for obtaining nickel powder.

The second aspect of the present invention is the method for producing nickel powder in which the operation A of the first aspect is performed repeatedly four times or more, and thus the reduction reaction is performed five times or more in total including the initial operation to obtain the nickel powder.

By controlling mixed state or adjusting an amount of a seed crystal used in a reaction, a particle size of nickel powder generated by a wet hydrogen reduction reaction, which has been difficult to control, can be controlled.

DETAILED DESCRIPTION

Figure 1:
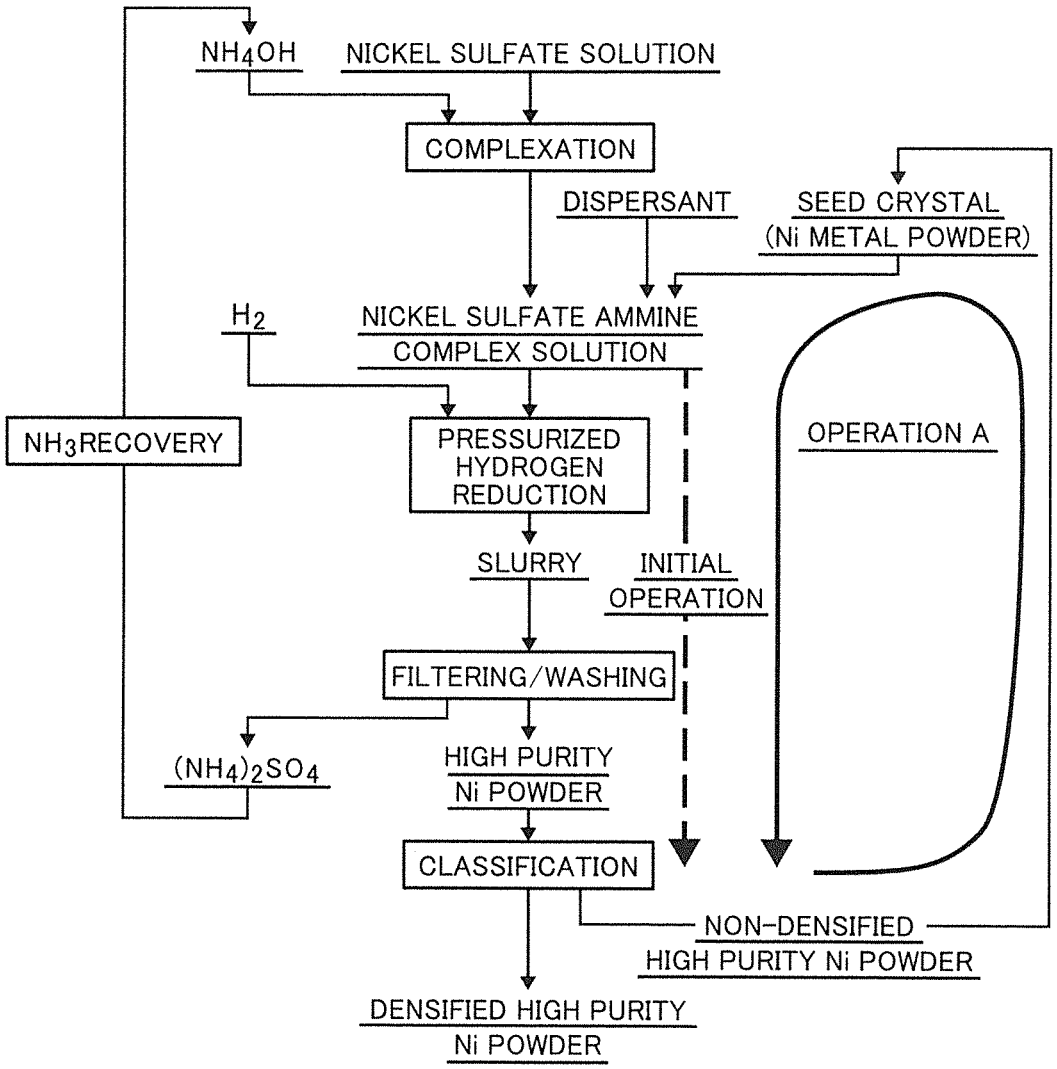
FIG. 1 is a flowchart for producing high density nickel powder having a particle size controlled and having an inside portion densified according to the present invention.

In the present invention, an initial operation for obtaining nickel powder having a controlled particle size is performed by performing a reduction reaction with hydrogen of a nickel complex ion contained in a nickel ammine complex solution with a limited prescribed mixed state and an amount of a seed crystal used in the reduction reaction adjusted, and thereafter, the following operation A is repeatedly performed.

In the operation A, the nickel powder obtained by the reduction reaction is separated according to a density, nickel powder having a low density is used as a seed crystal, and after obtaining a limited prescribed mixed state, the reduction reaction with hydrogen is performed to obtain nickel powder.

When the operation A is repeated, precipitation of nickel within the nickel powder proceeds, and a bulk density is more conspicuously increased as compared with growth in particle size, resulting in obtaining high density nickel powder.

With respect to the number of repeating times, the operation A is performed at least once for obtaining nickel powder having a median diameter of 100 μm or more and 160 μm or less and a bulk density of 1 to 4.5 g/cm$^3$, the operation A is repeated at least twice or more for obtaining a bulk density of 2 g/cm$^3$ or more, the operation A is repeated at least three times or more for obtaining a high bulk density exceeding 4 g/cm$^3$, and the operation A is preferably repeated four times or more for stably obtaining a higher bulk density, and in other words, the precipitation of nickel by the reduction reaction is repeated five times or more including the first precipitation (the initial operation). The operation A repeated five times (six times including the initial one) or more has, however, a little effect, and the density increase reaches a ceiling by repeating the operation A four times, and further repetition is not practically effective but is wasteful.

[Mixed State and Amount of Seed Crystal]

In the reduction reaction, a nickel concentration in the nickel ammine complex solution is 5 g/L or more and 75 g/L or less, and a mixed state in which the nickel powder used as the seed crystal is added in an amount of 5 g or more and 200 g or less per liter of the nickel ammine complex solution having the nickel concentration is formed.

For forming the mixed state, as a stirring speed for the mixed state is lower, a particle having a larger median diameter is generated, and when the stirring speed is the same, as the amount of the seed crystal is larger, the particle size (the median diameter) is increased. Therefore, the particle size of the nickel powder to be generated can be controlled by controlling the stirring power and adjusting the amount of the seed crystal.

[Separation of Nickel Powder]

Next, the separation according to a density may be performed as follows: the nickel powder is put in, for example, a cylinder filled with water, and the resultant cylinder is stirred and allowed to stand still in an upright position. Thus, nickel powder having a high density can be collected in a lower portion of the cylinder, and one having a low density can be collected in an upper portion. The thus obtained nickel powder having a low density is recovered in an amount appropriate for the necessary repetition.

EXAMPLES

The present invention will now be described with reference to examples.

Example 1

In Example 1, referring to the flowchart of FIG. 1 for preparing high density nickel powder having a controlled particle size and having an inside portion densified according to the present invention, the initial operation was performed through preparation procedures as described below, so as to check influence, of the mixed state and the amount of the seed crystal according to the present invention, on the control of a particle size of a nickel particle obtained by the reduction reaction, and to examine the mixed state and the amount of the seed crystal for obtaining nickel powder having a target particle size of 100 μm or more and 160 μm or less.

In FIG. 1, a broken arrow indicates the "initial operation", and a thick arrow indicates the "operation A".

[Preparation Procedures]

(Procedure 1)

Nickel powder having a particle size (a median diameter) of about 1 μm was prepared, and was dispensed in amounts of 5 g, 7.5 g, 15 g, and 22.5 g, and to each of these dispensed portions, 336 g of nickel sulfate hexahydrate, 330 g of ammonium sulfate, and 191 ml of 25% ammonia water were added, and about 440 ml of pure water was added thereto to obtain an original solution having a total volume adjusted to 1 liter. Such an original solution was prepared as two samples per dispensed portion, namely, eight samples in total were prepared.

(Procedure 2)

Each original solution prepared in Procedure 1 was put in an inner cylinder of an autoclave, and the inner cylinder was set in the autoclave.

(Procedure 3)

In this procedure, in order to check the influence of the mixed state, stirring was performed at stirring speeds of 500 rpm and 750 rpm respectively for the different addition amounts of the nickel powder. Incidentally, stirring power obtained at the stirring speed of 500 rpm was 3.6 W/L, and the stirring power obtained at the stirring speed of 750 rpm was 11.3 W/L.

(Procedure 4)

The temperature of the solution within the autoclave was increased up to 185° C.

(Procedure 5)

With the prescribed temperature kept, hydrogen gas was blown thereinto from a gas bottle so as to keep a total pressure at 3.5 MPa.

(Procedure 6)

After a lapse of 60 minutes from the start of the blowing of the hydrogen gas, the blowing of the hydrogen gas was stopped, and the temperature in the autoclave was lowered.

(Procedure 7)

After lowering the temperature down to 70° C. or less, the inner cylinder was taken out, the resultant solution was filtered to recover nickel powder, and the recovered nickel powder was washed and vacuum dried.

(Procedure 8)

A particle size (a median diameter) of the recovered nickel powder was measured using a particle size analyzer.

As a result of the measurement, it was found that nickel powder having a particle size of 100 to 160 μm can be obtained under conditions of the stirring speed and the addition amount of the seed crystal of Example 1.

Figure 2:
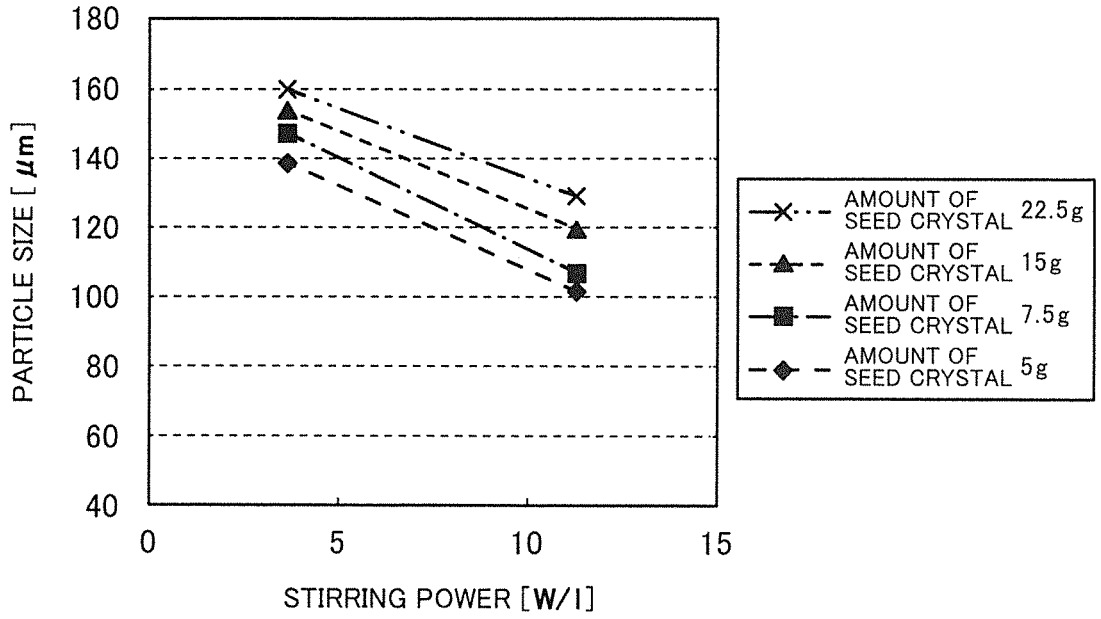
FIG. 2 is a graph illustrating a particle size (a median diameter) obtained by performing a hydrogen reduction reaction with various stirring powers and various amounts of a seed crystal.

It was found that, as illustrated in FIG. 2, as the stirring speed is lower, a particle having a larger median diameter is generated, and that the particle size (the median diameter) is larger as the amount of the seed crystal is larger when the stirring speed is the same. In other words, it was found that a particle size of nickel powder to be generated can be controlled by controlling the stirring power and adjusting the amount of the seed crystal.

Example 2

Nickel powder according to Example 2 was prepared in the same manner as in Example 1 through the following preparation procedures.

[Preparation Procedures]

<Initial Operation>

(Procedure 1)

Initial nickel powder was prepared using the same apparatus and the same method as those used in Example 1 except that 22.5 g of nickel powder having the same particle size of about 1 μm as that used in Example 1 is added as a seed crystal and the stirring speed was set to 500 rpm.

<Operation A>

(Procedure 2)

The nickel powder obtained in Procedure 1 was separated according to a density, and a portion on a low density side was dispensed in an amount of 91 g for observing a cross-sectional structure, and the dispensed portion was added to 336 g of nickel sulfate hexahydrate, 330 g of ammonium sulfate, and 191 ml of 25% ammonia water, and about 440 ml of pure water was added thereto to prepare a solution having a total volume adjusted to 1 liter.

Incidentally, for the separation according to a density, the nickel powder was put in a measuring cylinder filled with pure water, the resultant was stirred and then allowed to stand still, and the necessary amount of the nickel powder was dispensed from an upper portion.

(Procedure 3)

The solution prepared as described above was put in the same autoclave as that used in Example 1.

(Procedure 4)

The temperature in the autoclave was increased to 185° C. while stirring the solution at a stirring speed of 750 rpm, hydrogen gas was blown thereinto at 2 L/min (a flow rate under atmospheric pressure), and with the blowing of the hydrogen gas controlled to keep a total pressure of 3.5 MPa, a reduction reaction was repeatedly performed for the first time (the second time including the initial operation).

(Procedure 5)

After a lapse of 60 minutes, the blowing of the hydrogen gas was stopped, and the temperature in the autoclave was lowered.

(Procedure 6)

After lowering the temperature down to 70° C. or less, nickel powder was recovered from the autoclave by filtering and washing.

(Procedure 7)

Next, a low density portion of the thus recovered nickel powder in an amount of 129 g was dispensed in the same manner as described above, and the reduction reaction was repeatedly performed for the second time (the third time including the initial operation) in the same manner as in the repeated procedures of the first time (Procedures 2 to 6 of Example 2).

(Procedure 8)

Subsequently, a portion in an amount of 156 g was similarly dispensed from the recovered nickel powder, and the reduction reaction was repeatedly performed for the third time (the fourth time including the initial operation) in the same manner as in the repeated procedures of the first time (Procedures 2 to 6 of Example 2).

(Procedure 9)

Subsequently, a portion in an amount of 153 g was similarly dispensed from the recovered nickel powder, and the reduction reaction was repeatedly performed for the fourth time (the fifth time including the initial operation) in the same manner as in the repeated procedures of the first time (Procedures 2 to 6 of Example 2).

(Procedure 10)

Subsequently, a portion in an amount of 158 g was similarly dispensed from the recovered nickel powder, and the reduction reaction was repeatedly performed for the fifth time (the sixth time including the initial operation) in the same manner as in the repeated procedures of the first time (Procedures 2 to 6 of Example 2).

(Procedure 11)

Subsequently, a portion in an amount of 158 g was similarly dispensed from the recovered nickel powder, and the reduction reaction was repeatedly performed for the sixth time (the seventh time including the initial operation) in the same manner as in the repeated procedures of the first time (Procedures 2 to 6 of Example 2).

Incidentally, every time after completing the reduction reaction, a particle size (a median diameter) of the recovered nickel powder was measured using the same particle size analyzer as that used in Example 1. Besides, the cross-section was observed to check denseness inside the particle.

Furthermore, the nickel powder was put in a measuring cylinder, the resultant measuring cylinder was tapped for 3 minutes, and then, a bulk density was measured by a known method.

Figure 3:
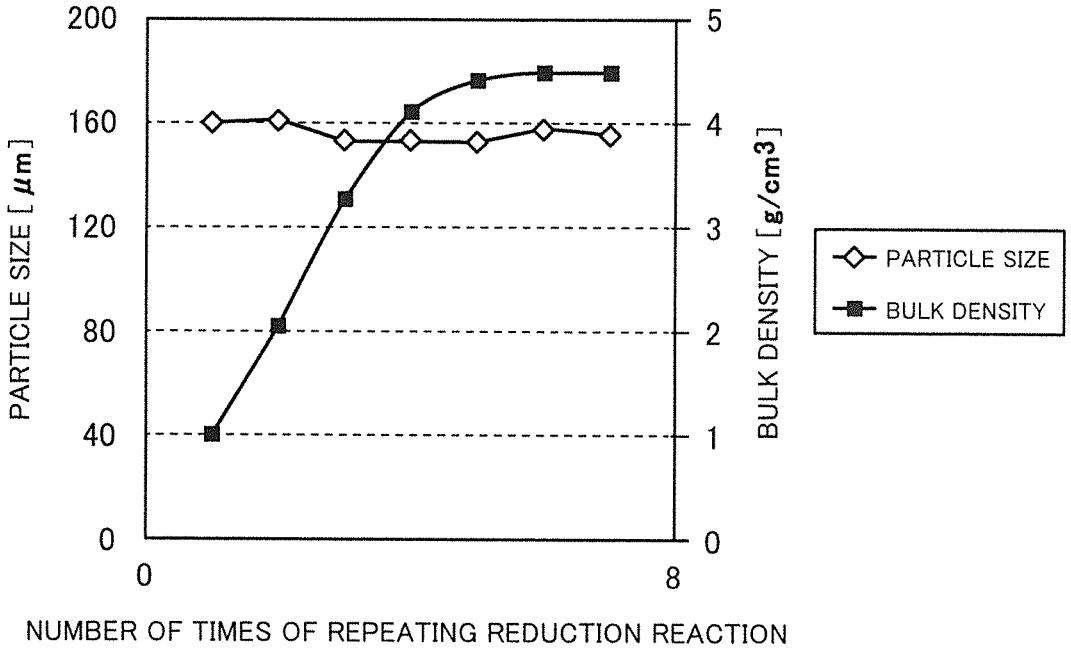
FIG. 3 is a graph illustrating a relationship among the number of times of a reduction reaction, a particle size (a median diameter), and a bulk density obtained by repeatedly performing the reduction reaction of nickel with hydrogen with high purity nickel powder having a controlled particle size used as a seed crystal.

The measurement results are illustrated in FIG. 3. In FIG. 3, the abscissa indicates the number of times of repeating the reduction reaction including the reduction reaction of the initial operation, the left ordinate indicates the particle size [μm], and the right ordinate indicates the bulk density [$g/cm^3$].

As illustrated in FIG. 3, even though the number of times of repeating the reduction reaction was increased, the particle size (the median diameter) was little changed, and it was found that nickel powder having a particle size of 100 to 160 μm and having a bulk density in the range of 1 to 4.5 $g/cm^3$ can be obtained under the conditions of the present invention.

It is also understood from FIG. 3 that the bulk density increases without increasing the particle size as the number of times of repeating the reduction reaction is increased. In other words, high density nickel powder is obtained. The bulk density abruptly increases if the number of times of repeating the reduction reaction including that of the initial operation is up to four, but if the number of repeating times is beyond four, and five or more, the increase in bulk density is small, and the bulk density shows a substantially constant value.

In other words, it is suitable to repeat the operation A four times, namely, to perform the reduction reaction by carrying out reduction processing five times including the reduction reaction of the initial operation.

Figure 4A:
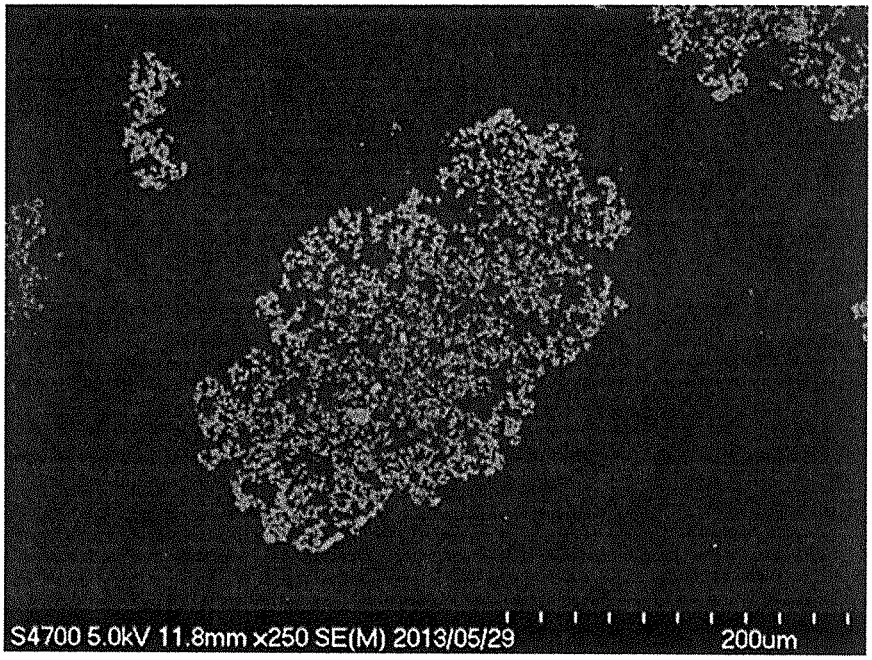
FIG. 4A illustrates cross-sectional views of nickel powder obtained by repeatedly performing the reduction reaction of nickel with hydrogen with the number of repeating times varied (after once and three times of the hydrogen reduction reaction) with high purity nickel powder having a controlled particle size used as a seed crystal.
Figure 4A:
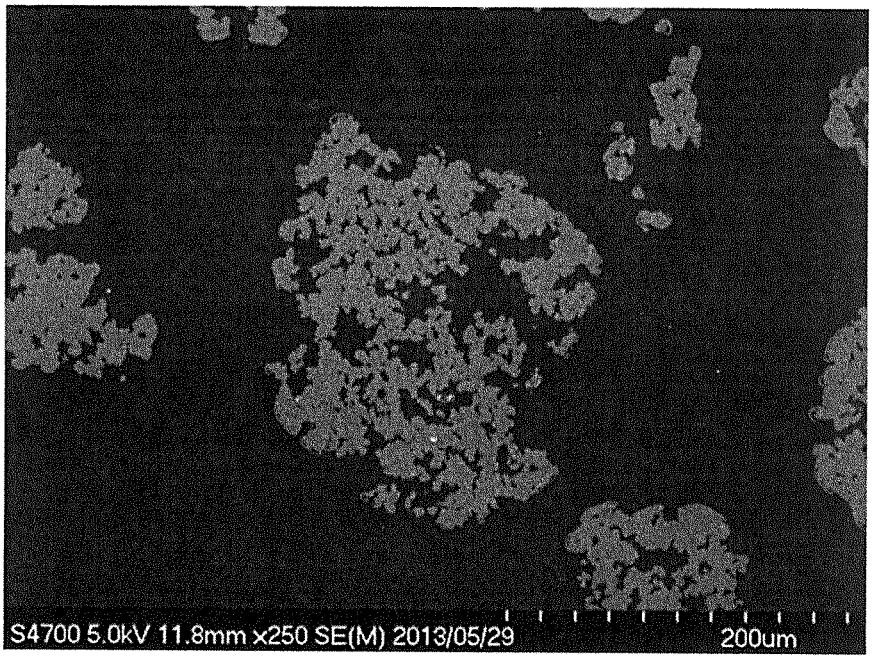
Figure 4B:
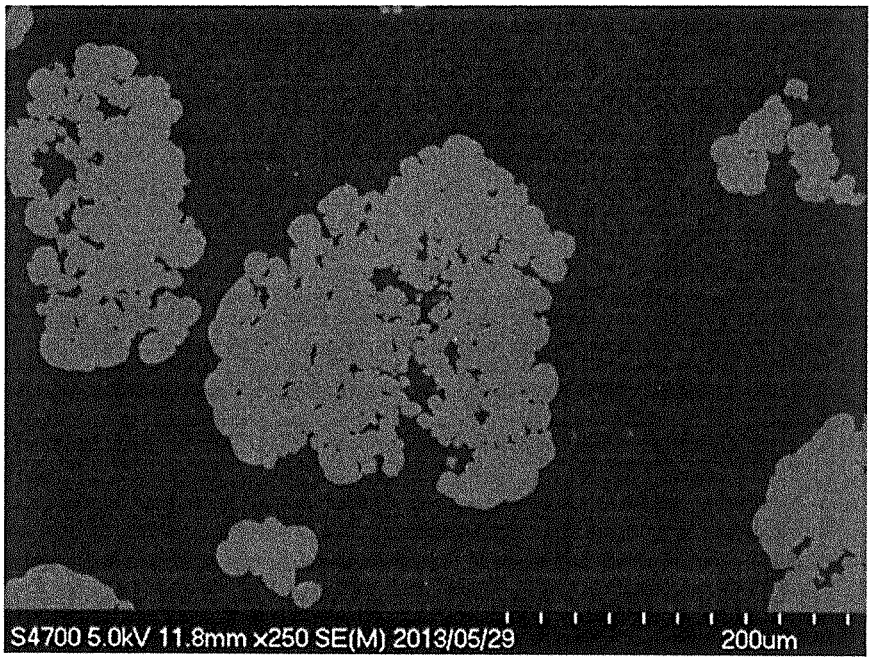
FIG. 4B illustrates cross-sectional views, following those of FIG. 4A, of the nickel powder obtained in a similar manner by repeatedly performing the reduction reaction of nickel with hydrogen with the number of repeating times varied (after five times and seven times of the hydrogen reduction reaction) with the high purity nickel powder having a controlled particle size used as the seed crystal.
Figure 4B:
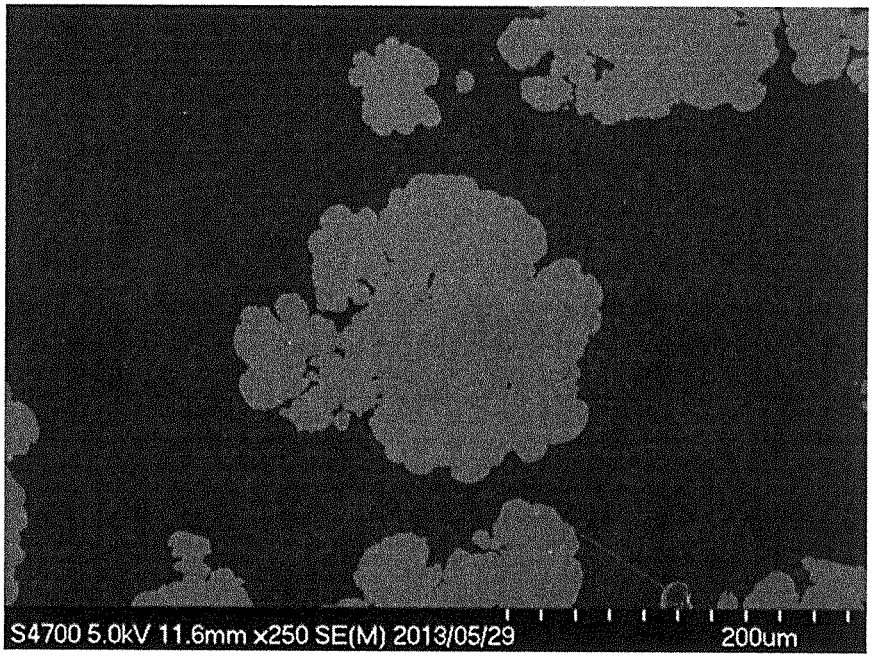

Besides, the nickel powder obtained with each number of repeating times was embedded in a resin, the resultant was polished, and the polished cross-section was observed with an electron microscope. Thus, it was confirmed, as illustrated in FIGS. 4A and 4B, that the inside portion of each particle was densified, resulting in increasing the bulk density.

The mechanism that the repetition of the hydrogen reduction does not increase the outer diameter but densifies the inside portion is not precisely clear, but, for example, the following is probably one of the causes: the nickel powder occludes supplied hydrogen, and the occluded hydrogen reduces a nickel ion contained in the solution in contact with the hydrogen inside the particle not affected by contact among the particles of the nickel powder.

In this manner, it was found that nickel powder having a particle size controlled to fall in a prescribed range and having a high density because of being densified inside can be produced by repeating a reduction reaction with high purity nickel powder having a controlled particle size used as a seed crystal.

Conventional Example

Figure 5:
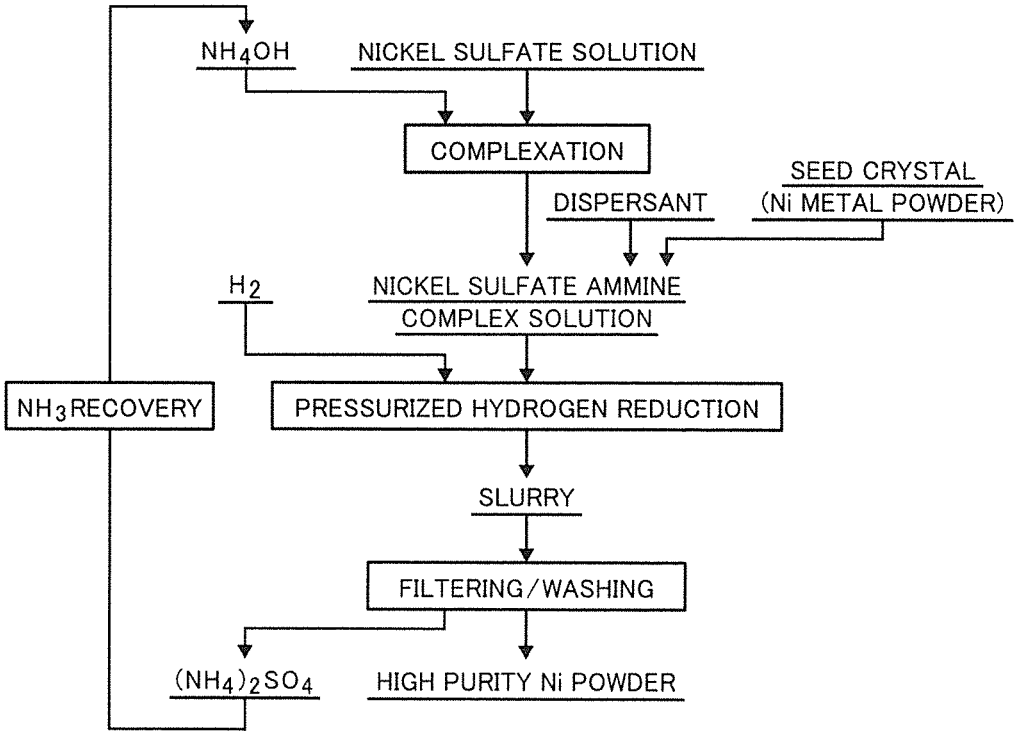
FIG. 5 is a flowchart for producing conventional nickel powder.

Referring to a conventional method for producing nickel powder illustrated in FIG. 5, nickel powder of a conventional example was prepared by using an original solution, which was prepared by adding, to 22.5 g of nickel powder having the same particle size of about 1 μm as that used in Example 1 as a seed crystal, 336 g of nickel sulfate hexahydrate, 330 g of ammonium sulfate, and 191 ml of 25% ammonia water, and adding about 440 ml of pure water to the resultant to adjust a total volume to 1 liter, and by using the same apparatus as that used in Example 1 except that the stirring was performed at a stirring speed less than 500 rpm.

The thus obtained nickel powder had a bulk density less than 1 g/cm$^3$.

The invention claimed is:

1. A method of producing nickel powder, comprising:

performing an initial operation by charging a pressure vessel equipped with a stirrer with a nickel ammine complex solution containing nickel in a concentration of 5 to 75 g/L together with seed crystals in an amount of 5 g to 200 g per liter of the complex solution, increasing a temperature of the solution, and blowing hydrogen gas into the pressure vessel for performing a reduction reaction with hydrogen, thereby obtaining the nickel contained in the nickel ammine complex solution as nickel powder; and thereafter performing an operation A repeatedly, the operation A including:

putting the obtained nickel powder in a cylinder filled with water;

stirring the nickel powder and the water in the cylinder;

allowing the cylinder to stand still in an upright position;

recovering from an upper portion of the cylinder a part of the obtained nickel powder; and charging the pressure vessel equipped with the stirrer with the recovered nickel powder used as the seed crystals together with the nickel ammine complex solution in an amount of 5 g to 200 g per liter of the nickel ammine complex solution containing nickel in the concentration of 5 to 75 g/L, increasing a temperature of the solution, and performing the reduction reaction with hydrogen by blowing hydrogen gas into the pressure vessel for obtaining nickel powder, to obtain the nickel powder having a median diameter of 100 μm or more and 160 μm or less, and having a bulk density of 1 to 4.5 g/cm$^3$.

2. The method of producing nickel powder according to claim 1, wherein the operation A is repeated four times or more and thus the reduction reaction is performed five times or more in total including the initial operation to obtain the nickel powder.

* * * * *